US010018305B2

(12) United States Patent
Kirby et al.

(10) Patent No.: US 10,018,305 B2
(45) Date of Patent: Jul. 10, 2018

(54) HEATER WITH REPLACEABLE CARTRIDGE

(71) Applicant: Algas-SDI International LLC, Seattle, WA (US)

(72) Inventors: Michael J. Kirby, Kent, WA (US); George M. Zimmer, Kent, WA (US)

(73) Assignee: ALGAS-SDI INTERNATIONAL LLC, Seattle, WA (US)

( * ) Notice: Subject to any disclaimer, the term of this patent is extended or adjusted under 35 U.S.C. 154(b) by 1289 days.

(21) Appl. No.: 13/750,767

(22) Filed: Jan. 25, 2013

(65) Prior Publication Data

US 2014/0212822 A1 Jul. 31, 2014

(51) Int. Cl.

| | |
|---|---|
| ***F17C 7/04*** | (2006.01) |
| ***F23D 14/18*** | (2006.01) |
| ***F23C 13/02*** | (2006.01) |

(52) U.S. Cl.

CPC ..... *F17C 7/04* (2013.01); *F23C 13/02* (2013.01); *F23D 14/18* (2013.01); *F17C 2201/0114* (2013.01); *F17C 2201/035* (2013.01); *F17C 2201/054* (2013.01); *F17C 2203/0617* (2013.01); *F17C 2205/018* (2013.01); *F17C 2205/0379* (2013.01); *F17C 2221/035* (2013.01); *F17C 2223/0153* (2013.01); *F17C 2223/033* (2013.01); *F17C 2225/0123* (2013.01); *F17C 2225/035* (2013.01); *F17C 2227/0302* (2013.01); *F17C 2227/0386* (2013.01); *F17C 2260/053* (2013.01); *F17C 2270/0134* (2013.01); *F17C 2270/0745* (2013.01); *F23C 2900/13001* (2013.01);

(Continued)

(58) Field of Classification Search

CPC ..... F23C 13/02; F17C 7/04
USPC ..... 431/268; 432/28
See application file for complete search history.

(56) References Cited

U.S. PATENT DOCUMENTS

| | | | |
|---|---|---|---|
| 1,948,298 | A | 2/1934 | Howard |
| 2,463,477 | A | 3/1949 | Buttner |

(Continued)

FOREIGN PATENT DOCUMENTS

| | | | |
|---|---|---|---|
| CA | 2 659 677 | A1 | 9/2010 |
| JP | 6-174233 | A | 6/1994 |

(Continued)

OTHER PUBLICATIONS

Two page sales flyer from Leo's Service (a Canadian company), advertising "The Leo Propane Pressure Recovery System." Obtained on about Jun. 23, 2010. Date of first printing unknown.

*Primary Examiner* — Avinash Savani
*Assistant Examiner* — Aaron Heyamoto
(74) *Attorney, Agent, or Firm* — Seed IP Law Group LLP

(57) ABSTRACT

A catalytic tank heater includes a removably attached catalytic heater cartridge having catalytic material. The heater is attached to an LPG tank to position the catalytic heater cartridge to face the tank. The catalytic heater cartridge covers a plenum chamber of the catalytic tank heater. A fuel distribution header and heating element are positioned within the plenum chamber and are controlled to initiate combustion of the catalytic material to heat the tank. Vapor from the tank is provided as fuel to the catalytic tank heater, and is regulated to increase heat output as tank pressure drops. The catalytic heater cartridge can be replaced with a new cartridge while at the location of the tank on a property.

15 Claims, 8 Drawing Sheets

(52) U.S. Cl.
CPC .... *F23D 2203/107* (2013.01); *F23D 2213/00* (2013.01); *F23D 2900/00003* (2013.01); *Y10T 29/4973* (2015.01); *Y10T 137/6443* (2015.04)

(56) References Cited

U.S. PATENT DOCUMENTS

| | | | | |
|---|---|---|---|---|
| 2,564,863 | A | 8/1951 | Strobel | |
| 3,253,641 | A | 5/1966 | Gutzeit | |
| 3,796,207 | A | 3/1974 | Olson | |
| 4,833,299 | A | 5/1989 | Estes | |
| 5,458,862 | A * | 10/1995 | Glawion | B01D 53/72 110/214 |
| 5,569,020 | A | 10/1996 | Griffin et al. | |
| 5,878,739 | A | 3/1999 | Guidry | |
| 6,119,598 | A | 9/2000 | Reynolds et al. | |
| 6,293,471 | B1 | 9/2001 | Stettin et al. | |
| 6,516,754 | B2 | 2/2003 | Chadwick | |
| 7,066,729 | B1 | 6/2006 | Rajewski | |
| 7,238,020 | B2 | 7/2007 | Yang et al. | |
| 7,248,791 | B2 | 7/2007 | Toth | |
| 7,319,814 | B2 | 1/2008 | Luo | |
| 7,410,619 | B2 | 8/2008 | Reiser et al. | |
| 9,523,498 | B2 | 12/2016 | Zimmer et al. | |
| 2001/0045061 | A1 * | 11/2001 | Edlund | B01B 1/005 48/76 |
| 2002/0124575 | A1 | 9/2002 | Pant et al. | |
| 2006/0076716 | A1 | 4/2006 | Hysky et al. | |
| 2009/0078247 | A1 | 3/2009 | Sun | |
| 2011/0132203 | A1 | 6/2011 | Tippmann, Sr. et al. | |
| 2011/0311928 | A1 * | 12/2011 | Zimmer | F17C 7/04 432/9 |
| 2017/0241639 | A1 | 8/2017 | Zimmer et al. | |

FOREIGN PATENT DOCUMENTS

| | | | |
|---|---|---|---|
| JP | 2002-181293 | A | 6/2002 |
| JP | 2002-340294 | A | 11/2002 |
| JP | 2004-257642 | A | 9/2004 |
| JP | 2004-360878 | A | 12/2004 |
| WO | 2009/003481 | A2 | 1/2009 |

* cited by examiner

HEATER WITH REPLACEABLE CARTRIDGE

BACKGROUND

Technical Field

Embodiments described in the present disclosure are directed generally to catalytic heaters having replaceable catalytic cartridges for heating applications.

Description of the Related Art

A number of fluids that are normally found in gaseous form are commonly stored and transported under pressure as liquids, including, for example, methane, butane, propane, butadiene, propylene, and anhydrous ammonia. Additionally, fuel gasses comprising one or more constituent gasses are also stored and transported under pressure as liquids, including, e.g., liquefied petroleum gas (LPG), liquefied natural gas (LNG), and synthetic natural gas (SNG). Of these, LPG is perhaps the most commonly used. Accordingly, the discussion that follows, and the embodiments described, refer specifically to LPG. Nevertheless, it will be understood that the principles disclosed with reference to embodiments for use with LPG tanks can be similarly applied to tanks in which other liquefied gases are stored or transported, and are within the scope of the invention.

LPG is widely used for heating, cooking, agricultural applications, and air conditioning, especially in locations that do not have natural gas hookups available. In some remote locations, LPG is even used to power generators for electricity. LPG is typically held in pressurized tanks that are located outdoors and above ground. Under one atmosphere of pressure, the saturation temperature of LPG, i.e., the temperature at which it boils, is around −40° C. As pressure increases, so too does the saturation temperature. LPG is held in a liquid state by gas pressure inside the tank. As gas vapor is drawn from the tank for use, the pressure in the tank drops, allowing more of the liquefied gas to boil to vapor, which increases or maintains pressure in the tank.

As the gas boils, the phase change from liquid to gas draws thermal energy from the remaining liquid, which tends to reduce the temperature of the LPG in the tank. If LPG temperature drops, the boiling slows or stops, as the LPG temperature approaches the saturation temperature. Thus, boiling LPG tends to increase pressure and saturation temperature, while at the same time tending to decrease the actual temperature of the LPG in the tank, until an equilibrium temperature is reached, at which point the saturation temperature is equal to the current temperature of the LPG. Provided the energy expended to vaporize the gas does not exceed the thermal energy absorbed by the tank externally, from, for example, sunlight and the surrounding air, the LPG will continue to boil as vapor is drawn off, until the tank is empty. On the other hand, if more energy is expended to vaporize the gas than is replaced by external sources, the temperature in the tank will drop toward the equilibrium temperature, resulting in less energetic boiling, and a drop in tank pressure. If tank pressure drops too low, it can interfere with the operation of appliances and equipment that draw gas for use, such as furnaces, ovens, ranges, etc.

For purposes of the following disclosure, the maximum continuous rate at which gas can flow from a supply tank using only ambient energy to vaporize the LPG, without causing the tank pressure to drop below an acceptable level, will be referred to as the maximum unassisted flow rate. It will be recognized that this rate will vary according to the ambient temperature near the tank.

Low tank pressure is a particular concern in regions where ambient temperature can drop to very low levels, such as during the winter at high latitudes, or at very high altitudes. For example, when ambient temperature drops very low, the heat energy available to warm an LPG storage tank is reduced, while at the same time, the cold temperature prompts an increased draw of gas to fuel furnaces to warm homes and other buildings. As gas pressure drops below the regulated pressure of the gas line, flames in furnaces, water heaters, and other gas consuming appliances reduce in size, producing less heat and prompting users to open gas valves further, which only accelerates the pressure drop. Eventually, tank temperature can drop below the boiling point of unpressurized gas, at which point, no gas will flow. It can be seen that, as ambient temperature drops, the potential for unacceptable loss of pressure increases, as does the potential demand for gas, such as for heating.

Generally, disadvantages of many of the systems available are often related to the difficulty of providing heat in the close vicinity of an LPG tank without creating a condition that would be dangerous in the event of a tank leak or tank over-pressure. The complexity of systems in which a heat source is remotely located not only increases the cost, but also the likelihood of malfunction. Additionally, vaporizers and heaters that employ electric heating elements, or that are electrically controlled, are impractical for use in applications where electrical power is not available. In such cases, an electric generator is required to provide the electricity, resulting in costly efficiency losses.

One problem associated with electric tank heaters, in particular, is that the heating element is in direct contact with the tank wall. Temperature differentials between the element and the tank can promote water condensation, which can be trapped between the heating element and the surface of the tank, resulting in deterioration of the paint and subsequent corrosion of the steel tank wall. Most jurisdictions have stringent regulations regarding the use of combustion sources near LPG tanks and gas transmission lines. These regulations dictate explosion-proof requirements for electrical connections, minimum distances to open flames, etc. The restrictions vary according to the size of a tank and proximity to public areas.

One problem associated with other tank heaters, in particular, is that servicing the heater and replacing integral components can be burdensome and costly in situations where the entire heater or other component must be sent to an off-site location from the storage tank for servicing. As such, the heater will be out of commission during such servicing, which negatively affects delivery of the fuel in the tank to a load.

BRIEF SUMMARY

According to an embodiment, a catalytic heating system is provided, including a catalytic tank heater removably coupled to a storage tank. When a load draws sufficient vapor to cause the tank to self refrigerate and lose pressure, the catalytic tank heater is operated to warm the tank and restore pressure. Vapor from the tank is provided as fuel to the tank heater, and can be regulated to increase heat output as tank pressure drops.

In some aspects, the catalytic tank heater includes at least one replaceable catalytic heater cartridge, having a catalyst layer with catalyst coating, for easy removal and replacement of the catalytic heater cartridge once the catalyst layer is no longer useful. A service technician (or even a customer) can remove the catalytic tank heater from the storage tank and simply remove the contaminated catalytic heater cartridge and replace it with a new catalytic heater cartridge, all while on-site and near the location of the tank. This provides particular benefits and advantages over existing systems (discussed further below). For example, the customer is not required to have the heater or heater elements serviced at a distant location away from the location of the storage tank, which may be a remote location in many instances. Furthermore, the heater will only be removed and inoperable for a relatively short period of time while the cartridge is being replaced. Current systems result in the heater being inoperable for weeks, or even months, while the sensitive catalytic material is merely replaced at a different location. Accordingly, providing a catalytic tank heater having at least one replaceable catalytic heater cartridge for easy replacement on-site provides at least these advantages over existing systems.

In some aspects, the catalytic tank heater may have a cabinet having an open space defining a plenum chamber. The replaceable catalytic heater cartridge is coupled to the cabinet of the heater and covers the open space to provide a substantially gas-tight seal to the plenum chamber. The replaceable catalytic heater cartridge faces the storage tank and is spaced therefrom a distance sufficient to permit passage of air between the catalytic heater cartridge and the storage tank.

In some aspects, a main fuel supply line is coupled to the plenum chamber and is configured to deliver fuel to the chamber from the storage tank, or from another fuel supply. A fuel distribution header, having a fuel supply port coupled to the main fuel supply line, is positioned in the plenum chamber and is configured to deliver fuel to the plenum chamber. In some aspects, a heating element is positioned at least partially within the plenum chamber and is configured to heat the catalyst layer of the replaceable catalytic heater cartridge and to initiate combustion when fuel is supplied to the plenum chamber. After multiple or continuous uses of the heater, the heater cartridge can be quickly and easily replaced with a new cartridge for further use of the heater. Methods of replacing the cartridge and heating a tank with the replaceable cartridge are also provided, as further discussed below.

According to another embodiment, a catalytic heater is provided having at least one replaceable catalytic heater cartridge for easy removal and replacement of the catalytic heater cartridge. The catalytic heater and the replaceable catalytic heater cartridge in this embodiment may have the same or similar features as the catalytic tank heater of the heater system described above and in regards to FIGS. 3-8. In this embodiment, the catalytic heater and replaceable catalytic heater cartridge may be utilized for heating in a variety of applications, such as for climate control, material and surface curing applications, and many other known or later known heating applications. As such, the heater and replaceable cartridge are not coupled to a storage tank for heating the fuel in the storage tank. Rather, the heater and replaceable cartridge are incorporated into other heating systems, such as portable systems coupled to propane tanks, or other gas supply lines or containers, for indoor or outdoor uses. In some aspects, the replaceable cartridge is utilized in industrial heating applications, such as for heating large facilities or for paint and material curing systems. As further discussed in the present disclosure, once the catalyst layer of the cartridge is consumed or otherwise contaminated after multiple or continuous uses of the heater, it can be quickly and easily replaced with a new cartridge for further use of the heater.

DETAILED DESCRIPTION

Figure 1:
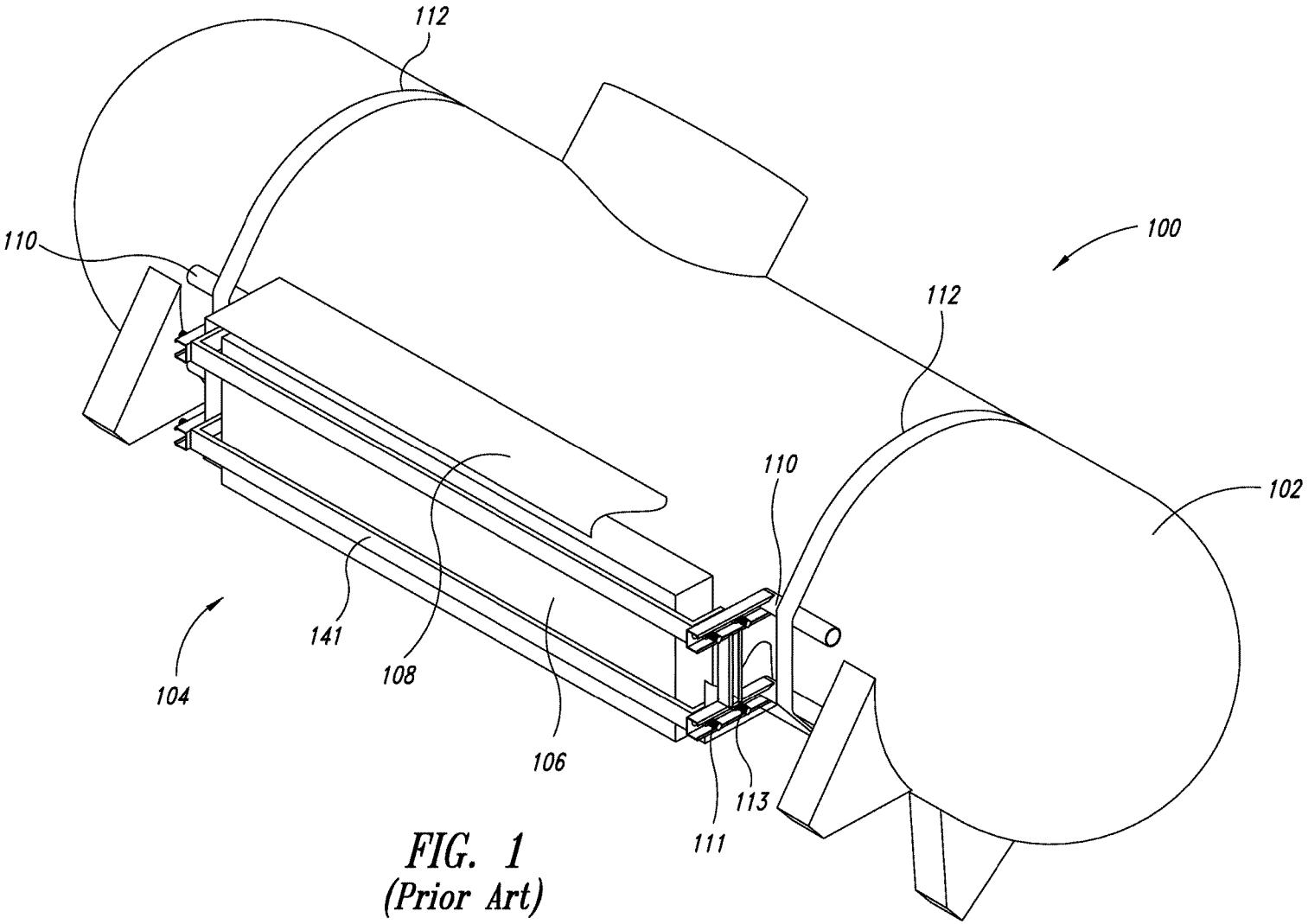
FIG. 1 (Prior Art)
FIG. 1 is a perspective view of an LPG storage system according to the prior art.
Figure 2:
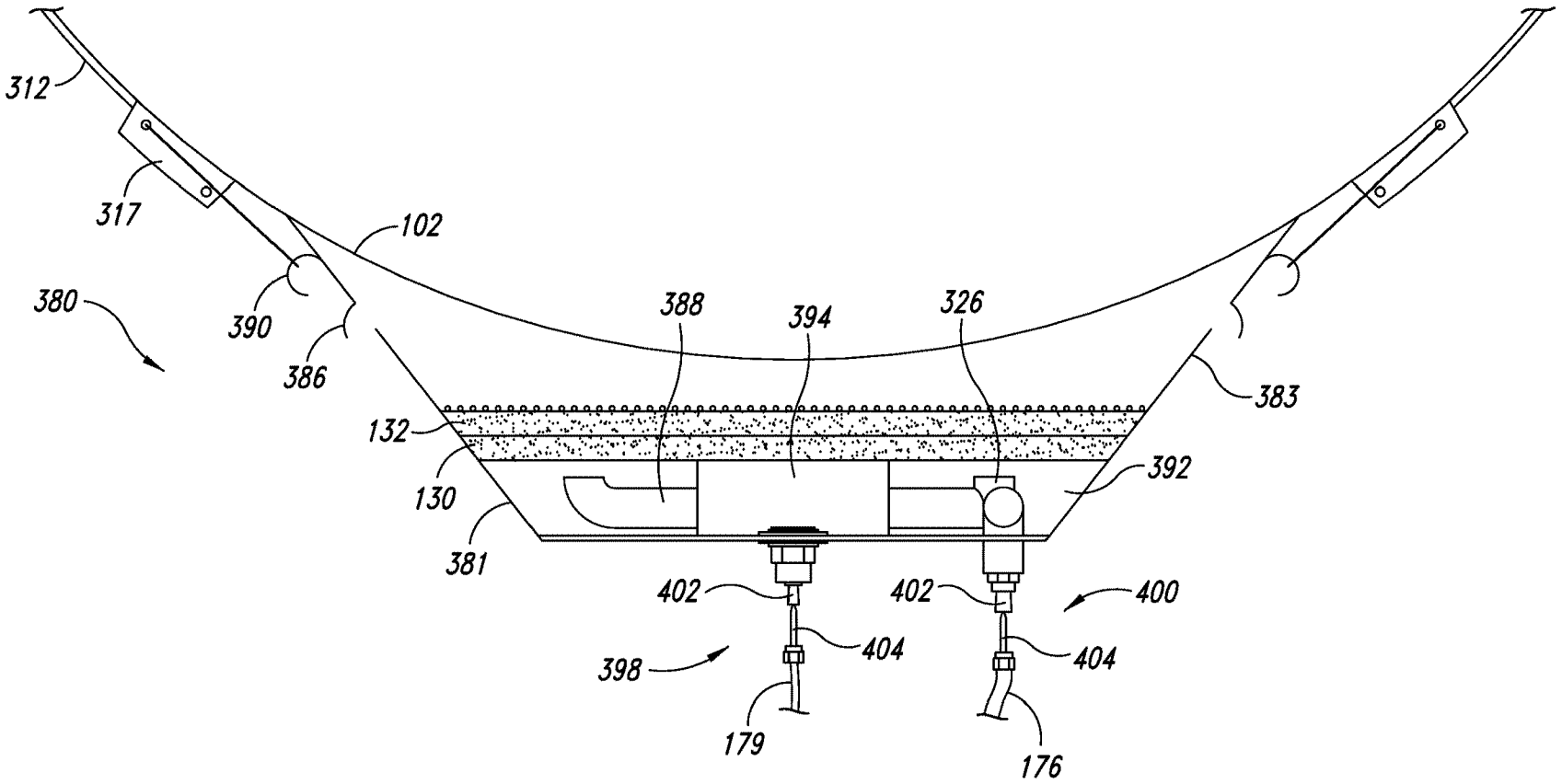
FIG. 2 (Prior Art)
FIG. 2 is a cross sectional end view of a tank heater of an LPG storage system according to the prior art.

FIG. 1 shows an LPG storage system 100 according to an existing system, which was disclosed in U.S. patent application Ser. No. 13/162,363 ("the '363 application"), filed Jun. 16, 2011, which application is incorporated by reference in its entirety. System 100 includes an LPG tank 102 and a catalytic tank heater system 104. The heater system 104 includes a catalytic heater element 106, a shroud 108, mounting brackets 141, support frames 110, and straps 112. The support frames 110 are coupled to the tank 102 by the straps 112. The catalytic element 106 is coupled to the mounting brackets 141, which extend between the support frames 110, and are coupled thereto by first fasteners 111. The shroud 108 is coupled to the support frames 110 by second fasteners 113. FIG. 2 shows a tank heater system 380 coupled to a tank 102 according to an embodiment known in the prior art, as disclosed in the '363 application. The heater comprises a housing 383 that includes a plenum chamber 392, a gas-permeable diffusion and insulation layer 130, and a catalyst layer 132 attached thereto.

With the known systems shown in FIG. 1, when the catalyst layer 132 has been contaminated from repeated/continuous use and requires replacement, a service technician must remove the entire heater element 106 from the heater system 104 and send or deliver it to a factory or to the manufacturer for removal and replacement of the catalyst layer 132 from the heater element 106. Once the heater element 106 is completely disassembled and the catalyst layer 132 is replaced, the heater element 106 is then sent back to the location of the storage tank 102 for reattachment to the heater system 104 and the tank 102. FIG. 2 further illustrates that the integral manner in which the catalyst layer 132 is included in the heater system 380, or the heating element 106 of FIG. 1, as disclosed in the '363 application.

These cumbersome and complicated procedures of these existing systems are required for at least two reasons. First, the catalyst layer 132 is quite difficult to handle because it is comprised of fibrous refractory material that is loose, pliable, soft and friable. The catalyst layers are typically comprised of a woven ceramic fiber pad that is treated with chemicals that attach to the fibers, such as platinum and palladium, which act as catalysts for the reaction between a combustion gas and oxygen. When such material is contaminated, it requires replacement by uncontaminated catalyst material, which requires servicing by skilled technicians at the manufacturer's factory or at a different servicing location. The second reason existing systems are cumbersome and complicated is because of the configuration of the existing heater system 104 and its heater element 106. As shown in FIG. 2, the heater includes the catalyst layer 132 and insulation layer 130 integrated into the heater or heater element 106 of FIG. 1 (see also FIGS. 5, 15, and 18 of the '363 application). Thus, when the catalyst layer 132 is contaminated, a service technician is required to travel to the location of the heater on the storage tank, remove components of the heater system from the storage tank, and then remove the heater element (having the catalyst layer) from the heater system, and then ship or deliver the heater element to an off-site location for removal and replacement of the catalyst layer, which is by itself a cumbersome procedure. Then, with the heater element in-hand, the service technician will travel back to the location of the storage tank and reattach the heater element to the heater system and then to the storage tank. Clearly, the existing process of replacing a contaminated catalyst layer in existing structures and heaters is burdensome, time consuming, and inefficient. Furthermore, there is a risk that the catalytic layer and the heating element may be damaged and/or improperly installed during some of the steps of the existing procedures due to the complicated configuration of the system and procedures to replace the contaminated catalyst layer. Such risks can result in an ineffective system and/or damage to property and/or injury to a person. The disclosure pertaining to the systems and methods discussed below regarding FIGS. 3-8 obviate at least the aforementioned deficiencies in the existing systems.

Figure 3:
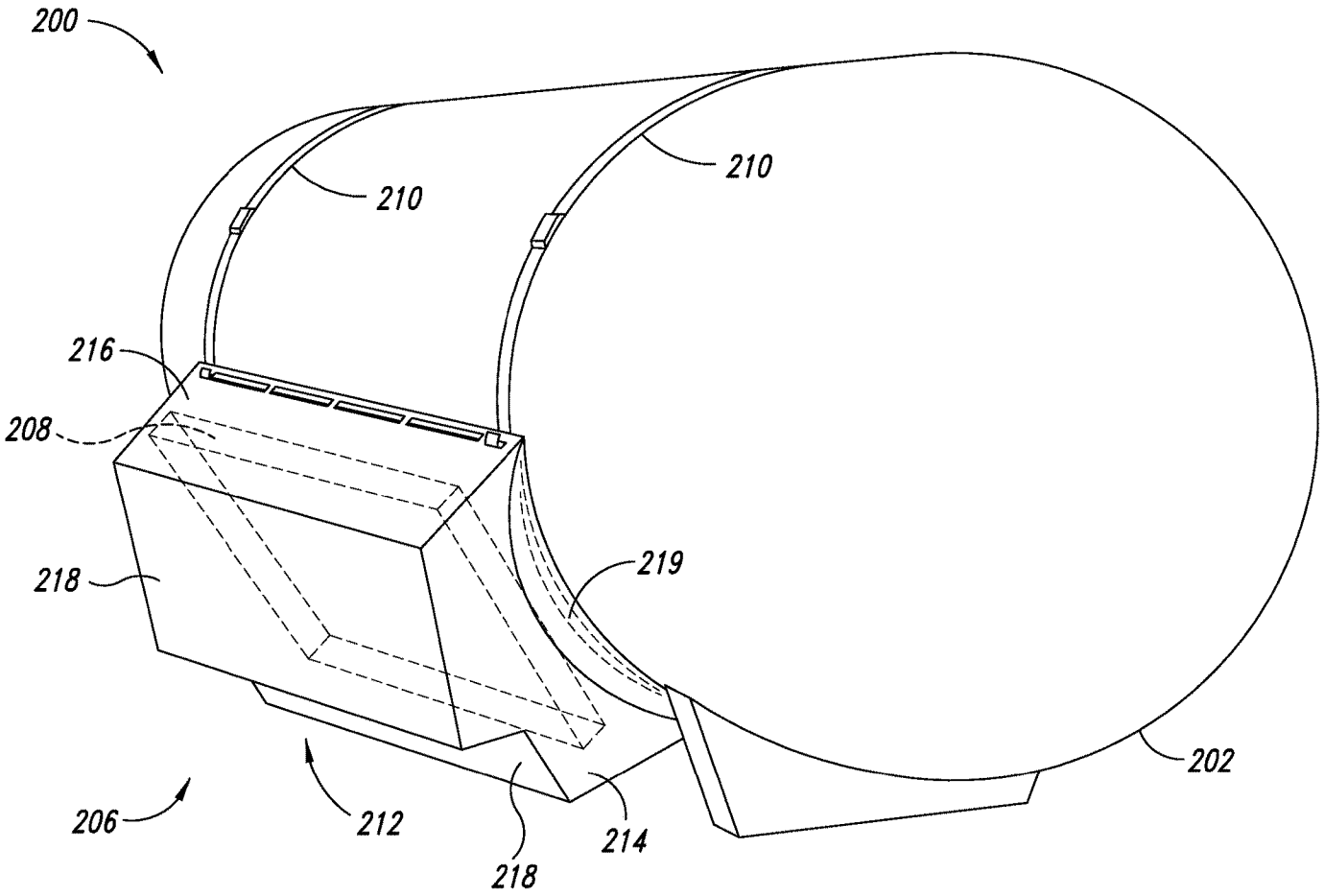
FIG. 3 is a perspective view of an LPG storage system according to an embodiment, including an LPG storage tank and a catalytic tank heater having a replaceable catalytic cartridge.

FIG. 3 shows an LPG storage system 200 according to an embodiment of the present disclosure, which includes an LPG storage tank 202 and a catalytic tank heater 206 having a replaceable catalytic cartridge 208. The catalytic tank heater 206 is coupled to the tank 202 by straps 210. The heater 206 includes a cabinet 212 having end walls 214, side walls 216, and a back panel 218. End walls 214 of the cabinet 212 can be shaped to conform to the curvature of the tank so that when installed, sidewalls 216, which extend between the end walls 214, can be positioned against the tank wall, so that substantially the entire perimeter of the open end of the cabinet 212 contacts the tank wall. The end walls 214 may include conformable panels 219 made from a resilient material such as, e.g., an elastomeric polymer like silicone, or synthetic rubber. When the cabinet 212 is positioned against the tank 202, the conformable panels 219 stretch to accommodate the curvature of the tank, thereby forming a substantially gas-tight seal.

For purposes of illustration, the replaceable catalytic cartridge 208 is shown as a shadow box positioned within the cabinet 212. According to one method of operation, when the replaceable catalytic cartridge 208 requires replacement, a service technician or customer can simply remove the catalytic tank heater 206 from the tank 202 and replace the used replaceable catalytic cartridge 208 with a new replaceable catalytic cartridge. Alternatively, the service technician can disconnect only the top side walls 216 from the straps 210, open the cabinet 212, replace the cartridge 208 and reconnect the top side walls 216 to the straps 210; complete removal of the cabinet 212 is not required. The catalytic tank heater 206 can then be reattached to the tank 202 without the need to remove the catalytic tank heater 206 from the location of the tank 202 for servicing, as discussed above regarding the existing systems of FIGS. 1 and 2.

Figure 4:
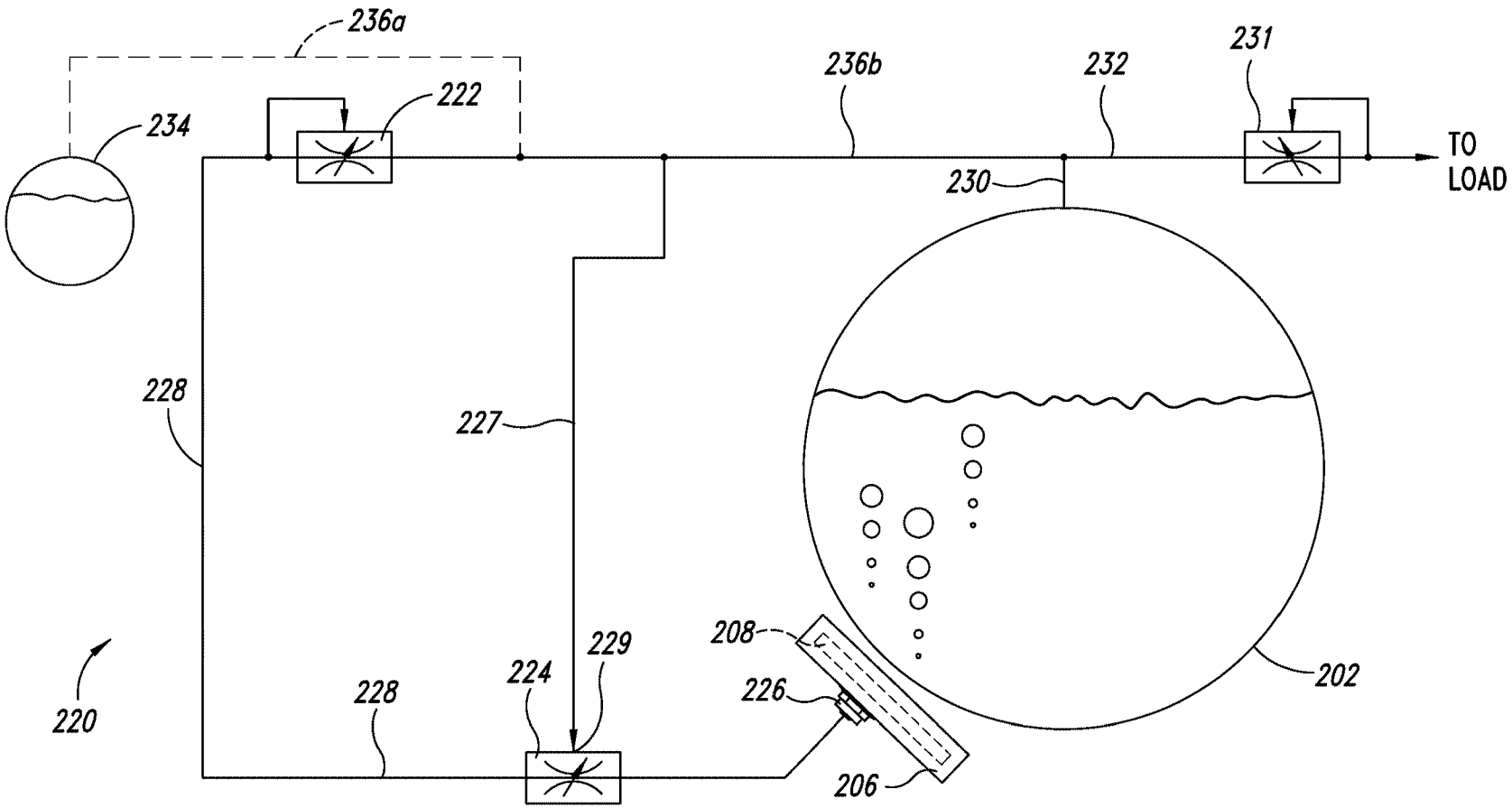
FIG. 4 is a schematic diagram of a catalytic tank heater control circuit according to an embodiment, including an LPG storage tank and a catalytic tank heater having a replaceable catalytic cartridge.

FIG. 4 shows a schematic drawing of a heater control circuit 220 according to one embodiment, which can operate, for example as a heater control unit for the catalytic tank heater 206 and cartridge 208 with regard to FIGS. 3, 5, 6, and 8. The heater circuit 220 includes first and second pressure regulator valves 222, 224. The catalytic tank heater 206 includes a gas supply port 226 coupled to the catalytic tank heater 206. Gas supply lines 228 extend from an outlet 230 of the tank 202 to the first pressure regulator valve 222, from the first pressure regulator to the second pressure regulator valve 224 and from there to the catalytic tank heater 206 via lines 228. A pressure feedback line 227 is coupled to provide direct tank pressure to a control terminal 229 of the second pressure regulator valve 224. The first pressure regulator valve 222 is configured to regulate pressure from the tank to an appropriate supply pressure, such as, e.g., 5 psi, which is provided to the second pressure regulator. Although not part of the heater control circuit 220, a third pressure regulator valve 231 is shown, coupled to regulate pressure in a gas supply line 232 to supply the load of the system. In embodiments where the supply pressures of the control circuit 220 and the load can be substantially equal, the third pressure regulator 231 may not be required. Instead, the first pressure regulator valve 222 may be configured to provide regulated gas to both the heater control circuit 220 and the load, in which case, the supply line 232 will be coupled to draw from the line 228 downstream from the first pressure regulator 222.

According to one method of operation, the tank 202 supplies vaporized gas to the load as required, according to known processes, absorbing heat from its environment to boil the liquefied gas as it is drawn. As long as the gas pressure remains above a selected threshold, the pressure at the control terminal 229 of the second regulator valve 224 is sufficient to hold the valve closed. However, in the event the pressure drops below the threshold, the valve 224 opens and catalytic tank heater 206 is activated to produce radiant heat by catalytic oxidation of the gas. As pressure drops in the tank 202, the reduction of pressure, as transmitted by the feedback line 227 to the control terminal 229 of the second regulator valve 224, opens the valve further, increasing the gas flow to the catalytic tank heater 206, and thereby increasing the amount of heat produced. As heat from the catalytic tank heater 206 is absorbed by the tank 202, it is conducted to the interior of the tank, and transferred to the liquefied gas inside, warming the gas and increasing the equilibrium temperature, resulting in an increased rate of boiling, thereby increasing tank pressure. The increased tank pressure is fed back, via the feedback line 227, to the second regulator valve 224, which reduces gas flow as the pressure rises, thereby regulating the tank pressure.

An optional alternate fuel source 234 is shown, coupled to the first regulator valve 222 via alternate gas supply line 236*a*, shown in dotted lines. In the case where a storage tank is used to store liquefied gas that is not appropriate for use in a catalytic heater system, such as, e.g., anhydrous ammonia, vapor from the storage tank cannot be used to operate the catalytic tank heater 206. In such a case, the feedback line 227 is coupled directly to the outlet 230 of the tank 202, and the alternate supply line 236*b* replaces the line 236*a* of the supply line 228. The heater control circuit 220 operates substantially as described above to control the catalytic tank heater 206 to warm the tank 202, but draws fuel from the alternate fuel source 234. Additional heater control circuits are described in the '363 application, which include features that may be used with the features of the present disclosure, such as with respect to the features pertaining to FIGS. 7, 11, 16, and 19 of the '363 application, for example. It will be appreciated that some or all of the features and embodiments disclosed in the '363 application may be utilized with the components of the present disclosure, particularly as pertaining to operation with the catalytic tank heater 206 and replaceable catalytic cartridge 208 of the present disclosure.

Figure 5:
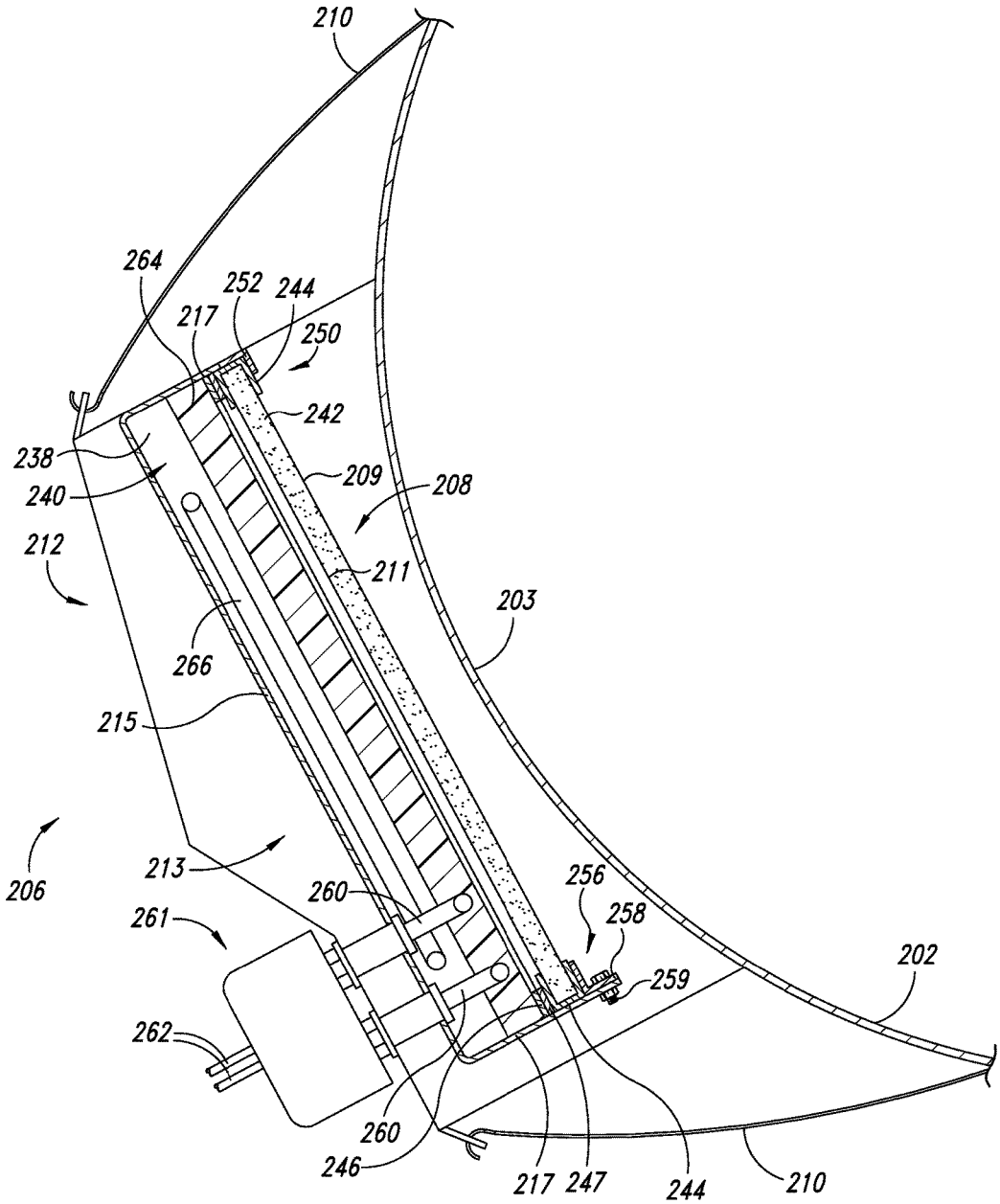
FIG. 5 is a cross sectional end view of the system of FIG. 3.

FIG. 5 shows an end view of a catalytic tank heater 206, having a replaceable catalytic cartridge 208, attached to a tank 202 by straps 210, such as shown in FIG. 3. The catalytic tank heater 206 includes the cabinet 212, which includes an inner cabinet 213 having a back panel 215 and side panels 217. The inner cabinet 213 of the catalytic tank heater 206 defines an open space 238 that defines a plenum chamber 240. In some aspects, at least one catalytic heater cartridge 208, containing a catalyst layer 242 having a catalyst material coating, is removably attached to the catalytic tank heater 206. Thus, an outer surface 209 of the catalytic heater cartridge 208 faces the tank 202 and is spaced therefrom a distance sufficient to permit passage of air between the catalytic heater cartridge 208 and a wall 203 of the tank 202.

Figure 7:
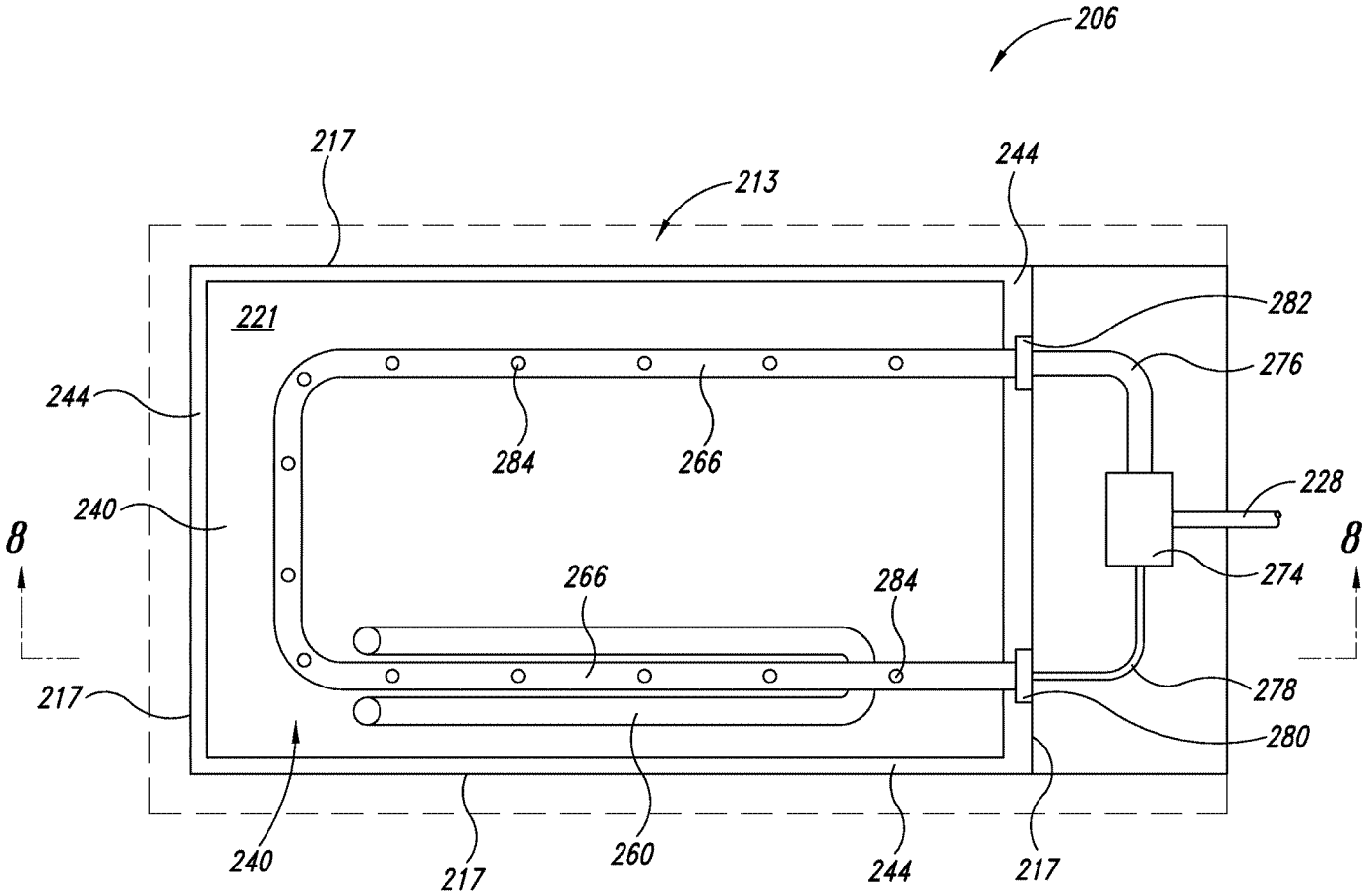
FIG. 7 is a diagrammatic plan view of a catalytic tank heater of FIG. 5, showing configurations and positions of various features as viewed from the back of the heater.
Figure 8:
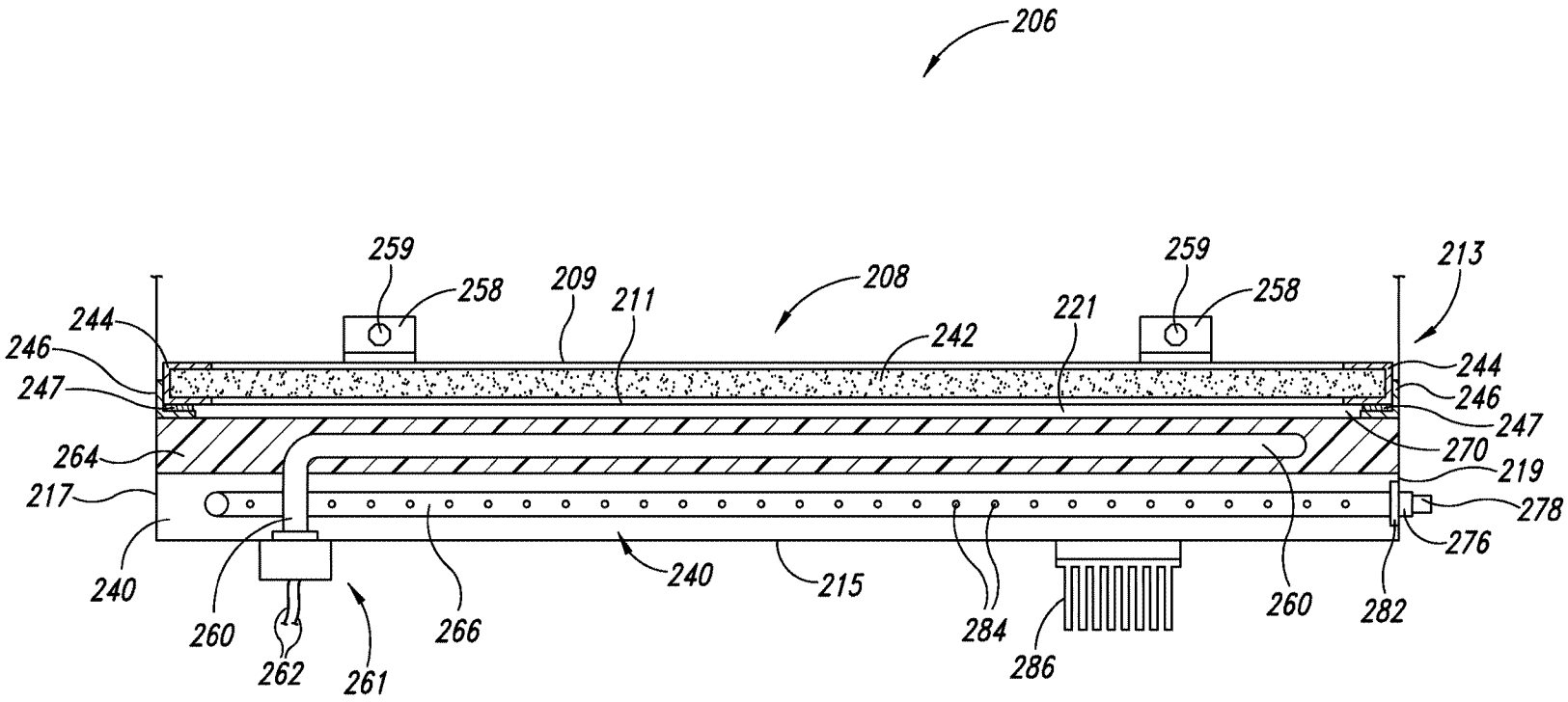
FIG. 8 is a diagrammatic view of the heater of FIG. 7 showing configurations and positions of various features, the view taken from a side of the heater along lines 8-8 of FIG. 7.

In some aspects, the catalytic heater cartridge 208 covers the plenum chamber 240 to provide a substantially gas-tight seal to the plenum chamber (FIGS. 7 and 8). The catalytic heater cartridge 208 includes a frame 244 that contains the catalyst layer 242. A sealing perimeter portion 246 extends around a perimeter of the inner cabinet 213 to properly position the catalytic heater cartridge 208 over the plenum chamber 240 (FIG. 7). A gasket 247 may be positioned between the frame 244 of the cartridge 208 and the sealing perimeter portion 246 to provide a substantially gas-tight seal so that any air or gas that enters the plenum chamber must pass through the catalytic layer 242. A first portion 250 of the frame 244 is slidably engaged to a flange 252 that extends a length of the plenum chamber 240 to secure the first portion 250 of the cartridge 208 to the catalytic tank heater 206. A second portion 256 of the cartridge 208 is held in place by L-brackets 258 and fasteners 259 that secure the second portion 256 to the catalytic tank heater 206.

In some aspects, to remove a used catalytic heater cartridge 208, a person removes the fasteners 259 and L-brackets 258, then moves the second portion 256 of the cartridge 208 in a direction away from the heater 206, and then slides the first portion 250 out of the flange 252. When the used catalytic heater cartridge 208 is detached, the heating element and other components of the heater can be more easily serviced and/or replaced than with existing systems. To attach a new cartridge to the catalytic tank heater 206, the person can slide the first portion 250 into the flange 252 and then secure the second portion 256 with the L-brackets 258 and fasteners 259. Replacing the used catalytic heater cartridge 208 can be accomplished without completely removing the catalytic tank heater 206 from tank 202 (perhaps by disengaging only one of the straps 210). More importantly, replacing the used catalytic heater cartridge 208 can be accomplished without removing the catalytic tank heater 206 from the location where the tank 202 is situated. This provides all the advantages discussed above regarding the replaceability of the catalytic heater cartridge 208 from catalytic tank heater 206, all while servicing the system on-site.

It will be appreciated that the catalytic heater cartridge 208 can be attached and removed from the catalytic tank heater 206 by other means and mechanisms, such as with other fasteners. The catalytic heater cartridge 208 may also be slidably engaged to the catalytic tank heater 206, such as a cassette. Accordingly, it is possible that it is not required to detach the catalytic tank heater 206 from the tank 202 because the catalytic heater cartridge 208 may simply slide into place from any position around the perimeter of the catalytic tank heater 206.

In some aspects, a heating device 261 having a heating element 260 is coupled to the cabinet 212. The heating element 260 is positioned at least partially or wholly within the plenum chamber 240 and is configured to heat and initiate combustion in the catalyst layer 242 when fuel is supplied to the plenum chamber 240. The heating element 260 may be an electric heating element having terminals 262 connected to a power source. At least a portion of the heating element 260 may extend through a gas-permeable diffusion and insulation layer 264 contained in the plenum chamber 240 (FIG. 8). The insulation layer 264 assists to evenly distribute the heat supplied by the heating element 260 and the gas supplied to the plenum chamber 240. In some aspects, a fuel distribution header 266 is positioned at least partially or wholly in the plenum chamber 240 and is configured to deliver fuel to the plenum chamber from the tank 202 (or from another fuel supply). As discussed above regarding FIG. 4, the gas supply line 228 may be coupled to the fuel distribution header 266 of the catalytic tank heater 206 to deliver fuel to the plenum chamber 240 (FIG. 7). To initiate combustion, the temperature of the catalyst layer 242 must be raised above its activation temperature, i.e., the temperature at which catalysis of the particular fuel and catalyst combination is self-sustaining. In the case of petroleum gas, the reaction temperature is about 250-400° F. (about 120-200° C.), depending on factors that include the formulation of the gas and the catalyst employed. Accordingly, the heating element 260, positioned adjacent to an inner face 211 of the catalyst layer 242, is heated to a temperature above the light-off temperature of the fuel supplied to the plenum chamber 240. Existing systems include a heating element positioned within a catalyst layer, which further complicates replacement of the catalyst layer. As shown in the present disclosure, the heating element 260 is spatially separated from and adjacent to the catalyst layer 242 of the cartridge 208.

As the temperature of the catalyst layer 242 reaches a selected threshold by conductive heat supplied by the heating element 260, gas is provided to the plenum chamber 240 via the fuel distribution header 266. The gas rises through the insulation layer 264 and to the heated catalyst layer 242 for combustion. The catalyst layer 242 is permeable to air, permitting air to pass into it, or as needed, through it to combust or react with the fuel provide from the plenum chamber. Once the heat output by the system is self-sustaining, electric power to the heating element 260 may be turned off or shut down so that no electrical component is active within the plenum chamber 240. The heat produced by the combustion of gas and oxygen, as facilitated by the catalyst material coating in the catalyst layer 242, is then transmitted by radiation to the wall 203 of the tank 202 to heat the LPG contained therein. The above heating operation may be accomplished and controlled by the control circuit 220 of FIG. 4, for example, or by other systems disclosed and incorporated herein. During use, some of the catalytic material in the layer 242 is consumed and in addition, the layer 242 may become contaminated, damaged or otherwise less effective. After many, many hours of use, the catalytic element 208 can therefore be easily replaced.

Figure 6A:
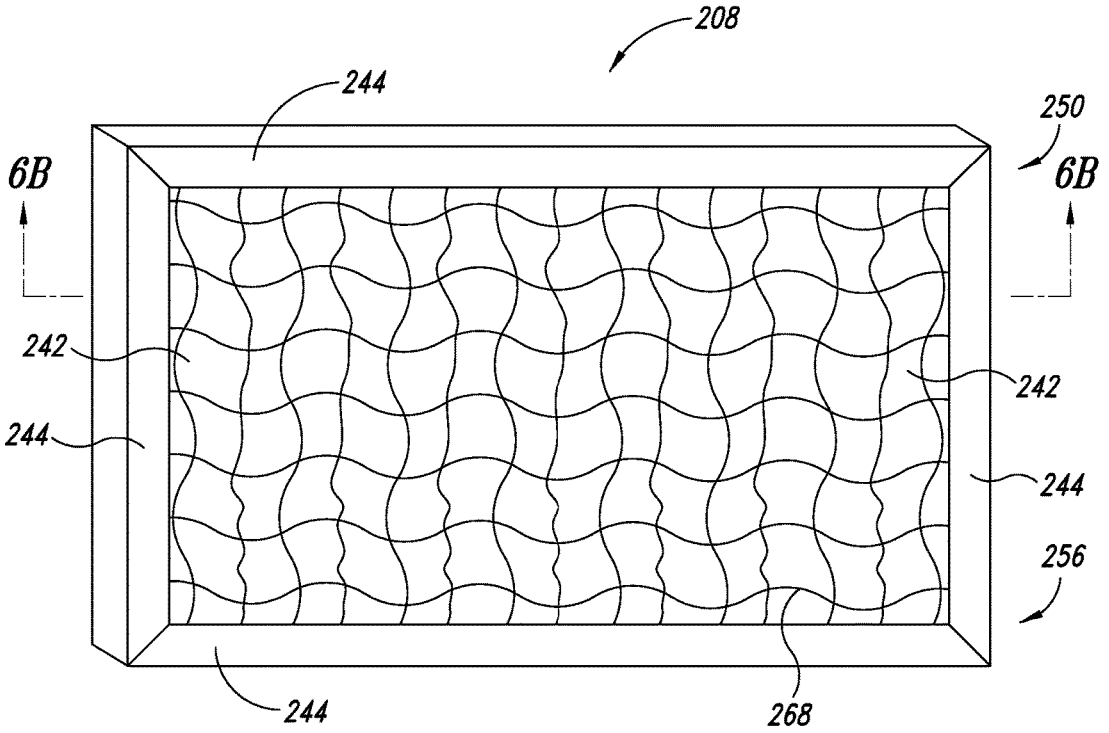
FIG. 6A is a perspective view of a replaceable catalytic cartridge according to one embodiment.
Figure 6B:
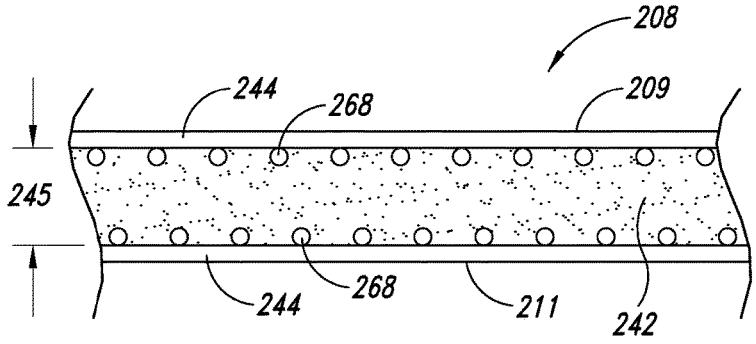
FIG. 6B is a cross sectional side view of the replaceable catalytic cartridge of FIG. 6A along lines 6B-6B.

FIG. 6A shows a catalytic heater cartridge 208 having a frame 244, and FIG. 6B shows a portion of a cross section of the cartridge 208 of FIG. 6A along lines 6B-6B. The catalytic heater cartridge 208 includes the frame 244, a pair of grids 268, and a catalyst layer 242. As discussed above, the first portion 250 is removably attached to a section of the heater 206, and the second portion 256 is removably coupled to an opposing section of the heater 206 to properly position the cartridge 208 adjacent the tank 102. The catalytic heater cartridge 208 may be symmetrical in at least one plane. The catalytic heater cartridge 208 may be sized such that the positions of the first portion 250 and second portion 256 are swapped. Furthermore, the catalytic heater cartridge 208 may be reversible such that the positions of the inner face 211 and outer face 209 are swapped.

As best shown in FIG. 6B, the catalyst layer 242 is contained within a catalyst area 245 defined by the frame 244. The pair of grids 268 assist to contain the catalyst layer 242 in the catalyst area 245 of the cartridge 208. The frame 244 may be comprised of aluminum tubing or other suitable material. The pair of grids 268 may be comprised of steel or other suitable material.

FIGS. 7 and 8 show a portion of the catalytic tank heater 206, such as shown in FIG. 5, for example. FIG. 7 shows the catalytic tank heater 206 in a bottom plan view, and FIG. 8 is a side view of the catalytic tank heater 206 of FIG. 7, taken along lines 8-8. Many features that are not essential to an understanding of the embodiment are omitted for simplicity. The catalytic tank heater 206 comprises an inner cabinet 213 that includes a back panel 215, side panels 217, and a front opening 221. A plenum chamber 240 is defined by the back panel 215, sides 217, and the front opening 221, as covered by the catalytic heater cartridge 208 when installed. As discussed above, the sealing perimeter portion 246 may extend around a perimeter of the inner cabinet 213 and above the insulation layer 264 to support the catalytic heater cartridge 208.

FIG. 7 further shows a gas valve 274 coupled to a gas supply line 228, which may be coupled to the tank 202 or a separate fuel supply. The gas valve 274 may operate similar to the second pressure regulator valve 224, controlled by circuit 220, described above with reference to FIG. 4, for example. Accordingly, the gas valve 274 is configured to regulate a volume of gas delivered to the plenum chamber 240. In some aspects, the gas valve 274 is coupled to a main fuel line 276 and a pilot fuel line 278. The main fuel line 276 is coupled to a main fuel supply port 282 of the fuel distribution header 266, and the pilot fuel line 278 is coupled to a pilot fuel supply port 280 of the fuel distribution header 266. The fuel distribution header 266 shown is a dual manifold having a plurality of apertures 284 through which gas is disbursed into the plenum chamber 240; however, other suitable manifolds or fuel delivery devices could be used.

Depending upon the heating requirements of the system (as further described above), the gas valve 274 may be regulated by the heater control 220 to provide a selected volume of gas to the plenum chamber 240 only via the pilot fuel line 278. As such, catalytic combustion may be initiated by the gas provided by the pilot fuel line 278 and the heat provided by the heating element 260. Once combustion or reaction is initiated and if the heater control 220 determines that the pressure level in the tank 202 is below the threshold value, the gas valve 274 may be regulated to provide gas to the plenum chamber 240 via the main fuel supply line 276 to the fuel distribution header 266. At such time, gas may continue to be provided to the plenum chamber 240 via the pilot fuel line 278 concurrently with the main fuel line 276, although not required.

As shown best in FIG. 8, an insulation layer 264 is positioned within the plenum chamber 240. The insulation layer 264 may be supported and separated from the back panel 215 by an internal grid or perforated panel (not shown). A convection space 270 may exist between the insulation layer 264 and the catalytic heater cartridge 208. The heating element 260 is positioned in the plenum chamber 240 and has at least a portion extending through the insulation layer 264. As further discussed above regarding FIG. 5, the heating element 260 is configured to heat and initiate combustion or reaction in the catalyst layer 242 when fuel is supplied to the plenum chamber 240. A gasket 247 is positioned between the sealing perimeter portion 246 and an inner surface of the catalytic heater cartridge 208. A pair of L-brackets 258 may be removably attached to the heater 206 by fasteners 259 to secure the catalytic heater cartridge 208 and to ensure a substantially gas-tight seal to the plenum chamber 240 over which the cartridge 208 is attached.

A thermoelectric device 286 may be coupled to the back panel 215 of the inner cabinet 213. Operation of thermoelectric devices are well known, and are commonly used to perform various functions, according to thermoelectric principles. The thermoelectric device 286 may generate electricity to power components of the system, such as the control circuit 220 and the gas valve 274, using waste heat produced by the catalytic tank heater 206, commonly known as the Seebeck principle. The thermoelectric device 286 may have the same or similar configuration as the thermoelectric device shown in FIG. 15 of the incorporated '363 application.

The various embodiments described above can be combined to provide further embodiments. The U.S. patent application referred to in this specification and/or listed in the Application Data Sheet is incorporated herein by reference, in its entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system, comprising:

catalytic heater housing having an open space defining a plenum chamber, a first side panel, and a second side panel;

a fuel supply line coupled to the catalytic heater housing and configured to deliver fuel to the plenum chamber from a fuel supply;

an insulation layer positioned within the catalytic heater housing;

a heating element positioned within the insulation layer extending along a length in a direction from the first side panel to the second side panel and being adjacent the plenum chamber;

at least one catalytic heater cartridge containing a layer of catalyst material, the at least one catalytic heater cartridge being positioned adjacent the insulation layer and the heating element and removably attached to the catalytic heater housing to be removed without removing the insulation layer and the heating element, and the at least one catalytic heater cartridge covering the plenum chamber with a gas-tight seal to provide a substantially gas-tight seal to the plenum chamber within the catalytic heater housing; and wherein the insulation layer and the catalytic heating cartridge extend from the first side panel to the second side panel.

2. The system of claim 1, further comprising a fuel distribution header positioned in the plenum chamber and configured to deliver fuel to the plenum chamber from the fuel supply.

3. The system of claim 1, further comprising a sealing perimeter portion extending along a perimeter of the plenum chamber, wherein the at least one catalytic heater cartridge is biased to the sealing perimeter portion to provide the substantially gas-tight seal to the plenum chamber.

4. The system of claim 1, wherein the catalytic heater housing includes at least one attachment device to removably attach the at least one catalytic heater cartridge to the catalytic heater housing.

5. The system of claim 1, wherein the catalytic heater housing is configured to be coupled to a storage tank with the at least one catalytic heater cartridge facing the storage tank and spaced therefrom a distance sufficient to permit passage of air between the catalytic heater cartridge and the storage tank.

6. The system of claim 1, wherein the heating element is an electric heating element configured to heat the catalyst layer and initiate combustion when fuel is supplied to the plenum chamber.

7. The system of claim 5, wherein the catalytic heater housing includes a cabinet to substantially enclose a space between the at least one catalytic heater cartridge and a wall of the storage tank when coupled thereto.

8. The system of claim 1, further comprising a gas valve having a main fuel inlet coupled to the fuel supply line and configured to regulate a volume of fuel passing through the gas valve to the plenum chamber.

9. The system of claim 8, wherein the gas valve includes a main fuel outlet coupled to one end of a fuel distribution header and a pilot fuel outlet coupled to the other end of the fuel distribution header, wherein the fuel distribution header is positioned in the plenum chamber.

10. The system of claim 1, wherein the catalytic heater housing includes a thermoelectric element configured to produce an electrical potential while a heat differential is present across the thermoelectric element, and wherein operation of a gas valve is powered by the electrical potential produced by the thermoelectric element.

11. A system, comprising:

a cylindrical storage tank configured to receive contents under pressure;

a catalytic tank heater having an open space defining a plenum chamber, a first side panel, and a second side panel, and having an electric heating element positioned within an insulation layer that is located within or adjacent the plenum chamber;

a main fuel inlet configured to deliver fuel to the plenum chamber;

a replaceable catalytic heater cartridge having a catalyst layer, the cartridge removably coupled to the catalytic tank heater and covering the plenum chamber, the cartridge facing the storage tank and spaced therefrom a distance sufficient to permit passage of air between the cartridge and the storage tank, and sufficiently close that substantially any heat radiated outward from a face of the cartridge impinges on a wall of the storage tank, the cartridge configured to be removed from the catalytic tank heater and replaced with a replacement catalytic heater cartridge without removing the insulation layer and the electric heating element of the catalytic tank heater from the storage tank; and wherein the insulation layer and the catalytic heating cartridge extend from the first side panel to the second side panel while the electric heating element extends along a length in a direction from the first side panel to the second side panel.

12. The system of claim 11 wherein the electric heating element is configured to heat the catalyst layer to initiate combustion when fuel is supplied to the plenum chamber.

13. The system of claim 11, further comprising a sealing perimeter portion defined by a perimeter of the plenum chamber, the replaceable catalytic heater cartridge biased to the sealing perimeter portion to provide a substantially gas-tight seal to the plenum chamber.

14. The system of claim 11, further comprising a fuel distribution header positioned in the plenum chamber and having a main fuel supply port and a pilot fuel supply port, both coupled to the main fuel inlet to deliver fuel to the fuel distribution header.

15. The system of claim 11, wherein the replaceable catalytic heater cartridge includes a perimeter frame having a pair of grids defining a catalyst area, wherein the catalyst layer is positioned within the catalyst area.

* * * * *